United States Patent [19]

Ohnuki

[11] 4,163,876

[45] Aug. 7, 1979

[54] ELECTRO-ACOUSTIC TRANSDUCER WITH VARIABLE THICKNESS FOAM SURFACED DIAPHRAGM

[75] Inventor: Nobutaka Ohnuki, Yokohama, Japan

[73] Assignee: Hitachi, Ltd., Japan

[21] Appl. No.: 921,907

[22] Filed: Jul. 5, 1978

[30] Foreign Application Priority Data

Jul. 6, 1977 [JP] Japan ..... 52-79849

[51] Int. Cl.[2] ..... H04R 7/02; H04R 9/02

[52] U.S. Cl. ..... 179/115.5 R; 179/181 F; 181/170; 181/174

[58] Field of Search ..... 179/115.5 R, 181 R, 179/181 F; 181/164, 165, 166, 167, 168, 169, 170, 171, 172, 173, 174, DIG. 1

*Primary Examiner*—George G. Stellar

*Attorney, Agent, or Firm*—Craig and Antonelli

[57] ABSTRACT

An electro-acoustic transducer having a flat sound radiating plane is disclosed, in which a voice coil bobbin having a voice coil wound around an outer circumference thereof is inserted in an air gap defined by an inner pole piece and an outer pole piece and dome-shaped diaphragm is inserted in the voice coil bobbin to define a front chamber surrounded by curved surfaces of an outer surface of the diaphragm and an inner surface of the voice coil bobbin, and foamed synthetic resin is filled in the front chamber.

5 Claims, 3 Drawing Figures

ELECTRO-ACOUSTIC TRANSDUCER WITH VARIABLE THICKNESS FOAM SURFACED DIAPHRAGM

Figure 1:
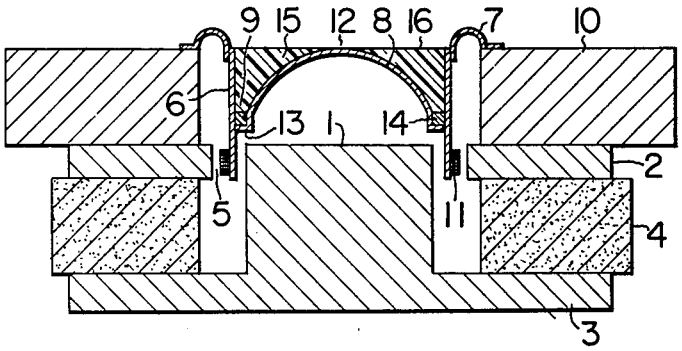

The present invention relates to an electroacoustic transducer for transducing an electrical signal to an acoustic signal, and more particularly to a dome-type loudspeaker for transducing an audio frequency signal to an acoustic signal.

It is necessary that the loudspeaker which is connected to a radio receiver or an audio frequency amplifier and to which an audio frequency signal such as a musical sound signal is supplied and which transduces the audio frequency signal to an acoustic signal exhibits a flat output sound pressure level over a wide frequency range and a wide directivity. The loudspeaker exhibits the directivity to a signal of a frequency higher than a frequency corresponding to a wavelength equal to a circumferential length of a diaphragm of the loudspeaker. Accordingly, a loudspeaker designed for reproducing a high frequency has a sharp directivity because a diameter of the diaphragm thereof is small. Therefore, a dome-type loudspeaker for reproducing high frequency components has been proposed in which the diaphragm thereof is of dome-shape to widen the directivity.

In the proposed dome type loudspeaker, a voice coil bobbin inserted in an air gap of a magnetic circuit thereof is supported by a support member fixed to a frame of the loudspeaker a peripheral edge of a dome-shaped diaphragm is fixed to an upper end of the voice coil, and an audio frequency signal is supplied to a voice coil wound on the voice coil bobbin to vibrate the voice coil bobbin and the diaphragm in an axial direction of the voice coil bobbin to reproduce an acoustic signal.

In such a dome-type loudspeaker, however, since the diaphragm projects forwardly from the front plane of the frame of the loudspeaker, only the diaphragm portion projects forwardly of a baffle board when the loudspeaker is attached to the baffle board having a flat surface. With this construction, sound waves radiated from the diaphragm include those radiated from an edge portion of the diaphragm and those radiated from the top surface of the diaphragm, and those sound waves interfere with each other to produce peaks or dips on a frequency vs output sound pressure (level) characteristic curve. This is not desirable.

In order to prevent undesired peaks or dips from appearing on the frequency vs output sound pressure characteristic curve, it is necessary to design the loudspeaker such that the sound waves radiated from the diaphragm are radiated from the same plane as the surface of the baffle board so that the sound waves radiated from the loudspeaker exhibit plane waves.

It is an object of the present invention to provide an electro-acoustic transducer which can exhibit a flat output sound pressure characteristic over an entire reproduced frequency band.

It is another object of the present invention to provide a dome-shaped loudspeaker which can exhibit a flat output sound pressure characteristic over an entire reproduced frequency band and in which mechanical strengths of the diaphragm and the voice coil bobbin are strong.

The electro-acoustic transducer in accordance with the present invention comprises a magnetic circuit including an inner pole piece and an outer pole piece which is disposed concentrically with the inner pole piece and which defines a ring-shaped air gap between itself and the inner pole piece, a voice coil bobbin inserted in the air gap of the magnetic circuit and a dome-shaped diaphragm fixed to the voice coil bobbin, wherein the diaphragm is inserted in the voice coil bobbin, the diaphragm and the voice coil are bonded together at a position such that the top of the outer periphery of the diaphragm is located substantially at an upper end of the voice coil bobbin to define a front chamber between an inner circumferential surface of the voice coil bobbin and an outer circumferential surface of the diaphragm, which front chamber is surrounded by those surfaces, foamed synthetic resin is filled in the front chamber, an inner upper end portion of the voice coil bobbin is flattened by the foamed synthetic resin and the diaphragm to define a sound radiating plane, which is a flat plane to allow that a plane wave is radiated therefrom.

Figure 2:
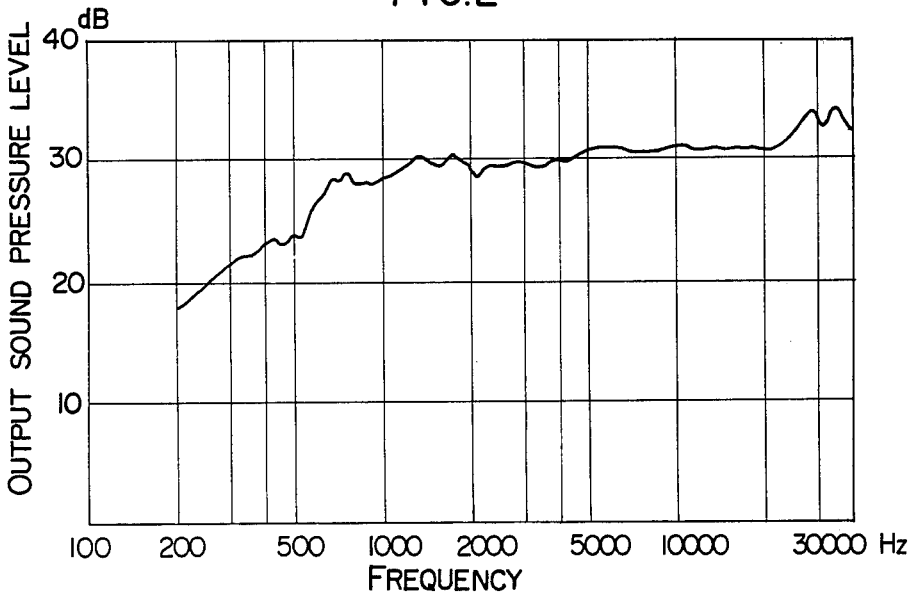
Figure 3:
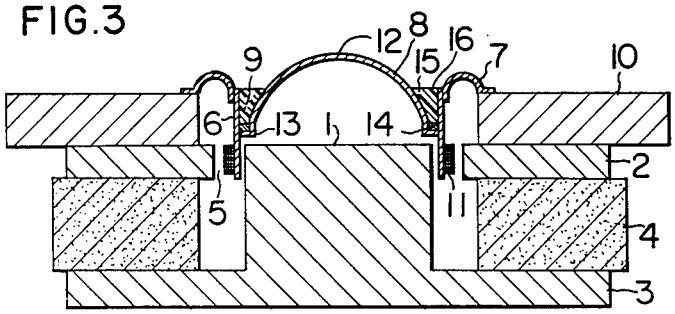

The other objects, features and advantages of the present invention will become apparent from the detailed description of the invention taken in conjunction with the accompanying drawings in which, FIG. 1 is a sectional view illustrating one embodiment of an electro-acoustic transducer of the present invention;

FIG. 2 shows a frequency vs output sound pressure characteristic curve of the electro-acoustic transducer of FIG. 1; and FIG. 3 shows a sectional view illustrating another embodiment of the electro-acoustic transducer of the present invention.

One embodiment of the electro-acoustic transducer in accordance with the present invention is explained with reference to the drawing. FIG. 1 shows one embodiment of the electro-acoustic transducer of the present invention, in which numeral 1 denotes a cylindrical inner pole piece made of a magnetic material, which is integral with a disk-shaped pole plate 3. Numeral 2 denotes a disk-shaped outer pole piece 2 made of a magnetic material, which has a center circular bore in which an upper end of the inner pole piece 1 is inserted. The inner pole piece 1 and the outer pole piece 2 are arranged concentrically to each other to define a ring-shaped air gap 5 between an outer circumferential surface of the inner pole piece 1 and an inner circumferential surface of the outer pole piece 2. A ring-shaped magnet 4 is inserted between the outer pole piece 2 and the pole plate 3, and the magnet 4 is bonded by adhesive material or fixed by bolts to the outer pole piece 2 and the pole plate 3. The inner pole piece 1, the outer pole piece 2, the pole plate 3 and the magnet 4 constitute a magnetic circuit of the electro-acoustic transducer, and magnetic flux from the magnet 4 are supplied to the air gap 5 and transverse the air gap 5. A ring-shaped frame 10 made of a magnetic material or a non-magnetic material such as aluminum is fixed at the top of the outer pole piece 2 by bolts or adhesive material. A cylindrical voice coil bobbin 6 made of paper or aluminum is inserted in the air gap 5, and an upper end of the voice coil bobbin 6 extends beyond the upper end of the inner pole piece 1 to substantially the same level as an upper surface of the frame 10. A voice coil 11 is wound around the outer circumferential surface of the voice coil bobbin 6 at a lower end thereof, and the voice coil 11 is disposed within the air gap 5 to interact with the magnetic flux from the magnet 4 which traverse the air gap 5. A support member 7 made of a compliant material is bonded to the outer circumference of the voice coil bobbin 6 at the upper end thereof, and the support member 7 is also bonded to the upper surface of the frame 10 so that the voice coil bobbin 6 is supported by the support member 7 such that the voice coil bobbin 6 is axially movable.

A dome-shaped diaphragm 8 made of aluminum or paper is inserted in the voice coil bobbin 6, with the diaphragm 8 being oriented such that a top 12 thereof is directed toward the upper end of the voice coil bobbin 6. The diaphragm 8 is bonded to the voice coil bobbin 6 at a position at which the top 12 of the diaphragm 8 coincides with the upper end of the voice coil bobbin 6. The outer circumferential portion of the diaphragm 8 extends vertically to define a flange 13, on which adhesive material 14 is applied, which adhesive material bonds the diaphragm 8 and the voice coil bobbin 6 together. Since the diaphragm 8 is inserted in the voice coil bobbin 6, a front chamber 9 surrounded by the inner circumferential surface of the voice coil bobbin 6 and the outer circumferential surface of the diaphragm 8 is defined in the voice coil bobbin 6. Foamed synthetic resin 15 such as polyurethane foam is filled in the front chamber 8. The foamed synthetic resin 15 is bonded to the inner circumferential surface of the voice coil bobbin 6 and the outer circumferential surface of the diaphragm 8 by the viscosity of the synthetic resin 15, or when the bonding between the synthetic resin 15 and the voice coil bobbin 6 and the diaphragm 8 is weak the synthetic resin 15 may be bonded by an adhesive material. The synthetic resin 15 is charged to the top level of the voice coil bobbin 6 so that the top end of the voice coil bobbin 6 is flattened by the top 12 of the diaphragm 8 and the foamed synthetic resin 15. The upper surface of the foamed synthetic resin 15 is at the same level as the upper surface of the frame 10, and the upper surface of the foamed synthetic resin 15 and the top 12 of the diaphragm 8 define a sound radiating plane 16.

When polyurethane foam is used as the synthetic resin 15 filled in the voice coil bobbin 6, a vibration system of the electro-acoustic transducer can be constructed in the following manner.

The cylindrical voice coil bobbin 6 is first formed of aluminum or paper, the diaphragm 8 is made by forming paper or aluminum into a dome shape, and the diaphragm 8 is inserted in the voice coil bobbin 6 and bonded thereto to define the front chamber 9 at the upper end of the voice coil bobbin 6. Then, 100 parts of tolylene diisocyanate and 90 parts of polyether are placed in a beaker and agitated at a room temperature. The resulting solution is poured into the front chamber 9 of the voice coil bobbin 6. The mixed solution of tolylene diisocyanate and polyether, when it is reacted, produces a compound having a cyclic urethane bond $$(-O-\overset{\overset{\displaystyle O}{\|}}{C}-N<)$$

and foams by gas which is generated during reaction to produce polyurethane. The polyurethane is produced in approximately five minutes since the mixing of tolylene diisocyanate and polyether, and foaming and hardening complete within this period. As the reaction and foaming of the mixed solution poured into the voice coil bobbin 6 proceed, the resultant product projects from the upper end of the voice coil bobbin 6. The projected portion is cut away after the reaction completed and the product was hardened, with the cutting plane being coplanar with the upper surface of the frame 10 to define the sound radiating plane 16. The polyurethane foam thus produced is imparted with viscosity during the production process and it adheres to the inner circumferential surface of the voice coil bobbin 6 and the outer circumferential surface of the diaphragm 8 by the viscosity thereof. Therefore, there is no need for separate adhesive material.

Since the electro-acoustic transducer thus constructed has the planar sound radiating plane 16, the sound wave radiated therefrom is a plane wave. Accordingly, the interference due to phase retardation is eliminated and the frequency vs output sound characteristic exhibits a flat characteristic over the entire reproduced frequency band.

In the electro-acoustic transducer shown in FIG. 1, the dome-shaped diaphragm 8 is inserted in the voice coil bobbin 6 with the top 12 of the diaphragm 8 being directed toward the upper end of the voice coil bobbin 6. Accordingly, the volume of the front chamber 9 is small and only a small amount of foamed synthetic resin 15 to be filled therein is needed. Therefore, a mass of the vibration system constituted by the voice coil bobbin 6 and the diaphragm 8 increases very slightly so that the efficiency of the electro-acoustic transducer is not substantially lowered.

FIG. 2 shows a frequency vs output sound pressure level characteristic of the electro-acoustic transducer shown in FIG. 1. The electro-acoustic transducer measured has the voice coil bobbin 6 made of aluminum of 50 $\mu$m thickness and having a diameter of 20.5 mm, and the diaphragm 8 made of aluminum of 20 $\mu$m thickness with the spherical dome portion having a radius of 15.1 mm, and having a diameter of 19.75 mm. The volume of the front chamber 9 is equal to 0.61 $cm^3$, into which polyurethane foam having a foaming factor of 30 is filled. A conventional dome-shaped electro-acoustic transducer exhibits a dip around 15 kHz on the frequency characteristic curve thereof, while the characteristic curve shown in FIG. 2 has no such dip and exhibits a flat output sound pressure characteristic over a frequency band from 1 kHz to 20 kHz.

FIG. 3 shows another embodiment of the electro-acoustic transducer of the present invention, in which the top 12 of the dome-shaped diaphragm 8 projects upwardly beyond the upper end of the voice coil bobbin 6. The volume of the front chamber 9 is reduced by the amount corresponding to the projection of the top 12 of the diaphragm 8 from the upper end of the voice coil bobbin 6. As in the electro-acoustic transducer shown in FIG. 1, the foamed synthetic resin 15 such as polyurethane foam is filled in the front chamber 9. Since the volume of the front chamber 9 of the electro-acoustic transducer shown in FIG. 3 is smaller, a smaller amount of foamed synthetic resin 15 may be filled therein and hence the mass of the vibration system is smaller than that of the electro-acoustic transducer shown in FIG. 1. Other synthetic resin than polyurethane foam, such as styrene resin may be filled in the front chamber 9 as the foamed synthetic resin.

What is claimed is:

1. An electro-acoustic transducer comprising:

an inner pole piece, an outer pole piece disposed concentrically to said inner pole piece to define a ring-shaped air gap between itself and said inner pole piece, a magnet magnetically coupled to said inner pole piece and said outer pole piece for supplying magnetic flux to said air gap, a cylindrical voice coil bobbin having a voice coil wound around an outer circumference thereof and inserted in said air gap, a support member for supporting said voice coil bobbin such that said voice coil bobbin can be axially vibrated in said air gap, a dome-shaped diaphragm inserted in and fixed to said voice coil bobbin, a front chamber surrounded by an inner circumferential surface of said voice coil bobbin and an outer circumferential surface of said diaphragm, and foamed synthetic resin filled throughout a space in said front chamber.

2. An electro-acoustic transducer comprising:

an inner pole piece, an outer pole piece disposed concentrically to said inner pole piece to define a ring-shaped air gap between itself and said inner pole piece, a magnet magnetically coupled to said inner pole piece and said outer pole piece for supplying magnetic flux to said air gap, a cylindrical voice coil bobbin inserted in said air gap and supported by a support member such that said voice bobbin can be vibrated axially of said inner pole piece, a voice coil wound around an outer circumference of said voice coil bobbin and inserted in said air gap, a dome-shaped diaphragm inserted in and fixed to said voice coil bobbin, said diaphragm having a top thereof disposed coplanar with an upper end of said voice coil bobbin, a front chamber surrounded by in inner circumferential surface of said voice coil bobbin and an outer circumferential surface of said diaphragm, and foamed synthetic resin filled throughout a space in said front chamber.

3. An electro-acoustic transducer according to claim 2 wherein said synthetic resin filled in said front chamber is formed of polyurethane foam.

4. An electro-acoustic transducer comprising:

an inner pole piece, an outer pole piece disposed concentrically to said inner pole piece to define a ring-shaped air gap between itself and said inner pole piece, a magnet magnetically coupled to said inner pole piece and said outer pole piece for supplying magnetic flux to said air gap, a voice coil bobbin inserted in said air gap and supported such that said voice coil bobbin can be vibrated axially of said inner pole piece, a voice coil wound around an outer circumference of said voice coil bobbin and inserted in said air gap, a dome-shaped diaphragm inserted in and fixed to said voice coil bobbin, said diaphragm having a top thereof projecting from an upper end of said voice coil bobbin and defining a front chamber between an outer circumferential surface of said diaphragm and an inner circumferential surface of said voice coil bobbin, and foamed synthetic resin filled in said front chamber.

5. An electro-acoustic transducer according to claim 4 wherein said synthetic resin filled in said front chamber is formed of polyurethane foam.

* * * * *